United States Patent [19]

Donan, Jr.

[11] 4,293,244

[45] Oct. 6, 1981

[54] PICK ARM ANCHOR ASSEMBLY

[75] Inventor: David C. Donan, Jr., Manitou, Ky.

[73] Assignee: Waimea Company Inc., Manitou, Ky.

[21] Appl. No.: 61,595

[22] Filed: Jul. 30, 1979

[51] Int. Cl.[3] ..... E21D 21/00

[52] U.S. Cl. ..... 405/259; 411/75

[58] Field of Search ..... 405/259-262; 85/79, 84, 85, 63, 62, 61, 64-74

[56] References Cited

U.S. PATENT DOCUMENTS

| | | | |
|---|---|---|---|
| 2,181,657 | 11/1939 | Herst | 85/79 X |
| 3,022,700 | 2/1962 | Dempsey | 85/79 X |
| 3,192,822 | 7/1965 | Genter | 85/79 |
| 3,216,306 | 11/1965 | Taylor | 85/79 |
| 3,478,641 | 11/1969 | Dohmeier | 85/79 |
| 3,799,027 | 3/1974 | Galloway | 85/79 |
| 3,844,194 | 10/1974 | Reinwall | 85/79 |

*Primary Examiner*—Dennis L. Taylor
*Attorney, Agent, or Firm*—James R. Higgins, Jr.

[57] ABSTRACT

A pick arm anchor assembly for use as a rock or mine roof bolt hole anchor characterized by an arrangement of components into an assembly which can be either used in conjunction with conventional expansion type rock anchors or it can be used independently with a mine roof bolt (without the expansion type anchor) to reinforce tunnel rock strata or mine roof strata. For a given hole diameter the assembly provides deeper penetration of the rock strata than conventional anchors. It also uses a greater concentration of transverse thrust in a small area to overcome rock stress resistance, to aid in penetration of the rock strata of a bolt hole. By deeper penetration of the rock strata of the bolt hole, the rock stress resistance to longitudinal forces is utilized in addition to the rock stress resistance to transverse forces employed in conventional expansion shell type anchors.

5 Claims, 17 Drawing Figures

PICK ARM ANCHOR ASSEMBLY

BACKGROUND

In mining and tunneling operations, roof bolts with expansion shell type anchors are used extensively. The expansion shell type anchors have proven to be ineffective in tunnel strata or mine roof strata composed of soft rock formations; consequently they contribute to unsafe working conditions in tunnels and mines. Where the pressure exerted through the expansion shell to the wall of the bolt hole exceeds the compressive strength of the rock formation, the yielding rock strata decreases the load bearing capacity of the roof bolt assembly.

The pick arm anchor assembly provides a means by which the anchoring point of the pick arm can be deeply imbedded into the wall of the bolt hole, providing a more effective anchor for the roof bolt in soft rock formations.

STATE OF THE ART—CROSS REFERENCES

The conventional anchor assembly employs a threaded wedge nut to advance down the threaded stem of a roof bolt as the bolt is rotated (tightened) and engage and expand an outer expansion shell unit (or the wings thereof) into the walls of a bolt hole, and the maximum expansion of the conventional expansion anchor is limited to one half (½) or less of the diameter of the anchor assembly. The anchoring ability is based on the friction created between the expansion shell wings and the wall of the bolt hole, by transverse thrust forces of the anchor and the transverse stress resistance of the rock strata of the wall of the bolt hole.

Reference is made to the following U.S. Pats., believed to disclose the state of the art as presently utilized in mining and other operations:

No. 691,921 1902 Wheeler;
No. 3,022,700 1962 Dempsey;
No. 3,139,730 1966 Williams.

SUMMARY OF THE INVENTION

The pick arm anchor assembly uses an off-center bias slanted thrust wedge to force the pick arm (with a sharp pointed configuration) into the interior wall (rock strata) of the bolt hole. The off-center bias design permits greated depth of penetration by the pick arm than that of a symmetrical expanding shell for a given hole diameter. Although the pick arm anchor assembly has a friction surface on a backup wing to grip the interior of the bolt hole, the pointed part of the pick arm is designed to penetrate the rock strata exposed in the interior of the bolt hole. Penetration of the rock strata by the pick arm utilizes the longitudinal stress resistance of the rock to assist in the anchoring function. The back up wing utilizes the transverse stress resistance of the rock strata to assist in the anchoring function. The pointed configuration of the point of the pick arm allows a unit of thrust applied through the roof bolt stem and in turn through the bias thrust wedge to the pick arm to be concentrated in a much smaller surface area of the bolt hole wall than is possible from the wings of a conventional expansion shell anchor. The greater anchoring ability in soft rock formations provides for safer working areas where the pick arm anchor is employed.

DETAILED DESCRIPTION OF THE INVENTION

Figure 1:
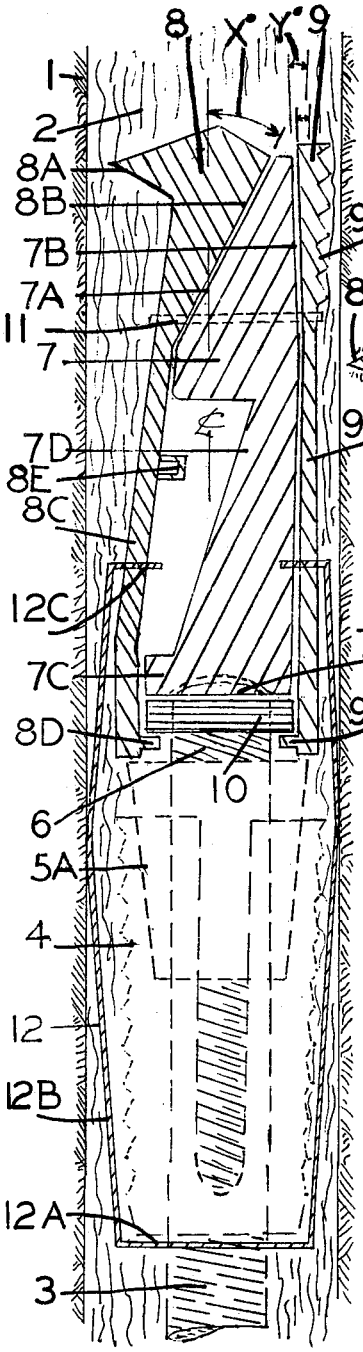
FIG. 1 Partial sectional view of the pick arm anchor assembly installed in a bolt hole in connection with a conventional expansion type roof bolt anchor assembly. This view is before the assembly is tightened, or anchored in the bolt hole.
Figure 2:
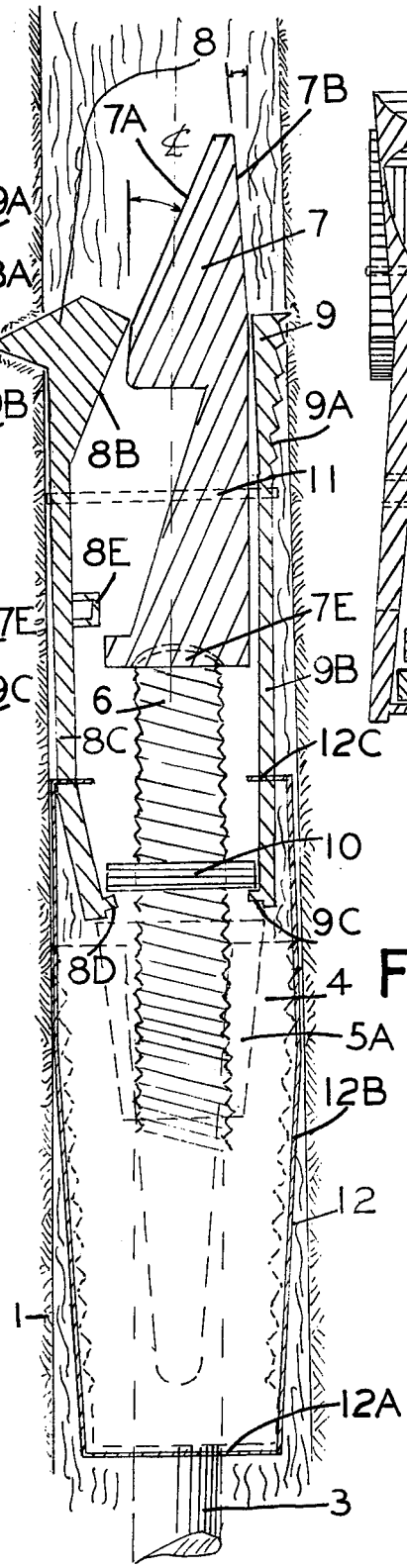
FIG. 2 A partial sectional view of the pick arm anchor assembly with a conventional type expansion shell anchor, after the assembly has been tightened or anchored in place in the bolt hole wall.
Figure 3:
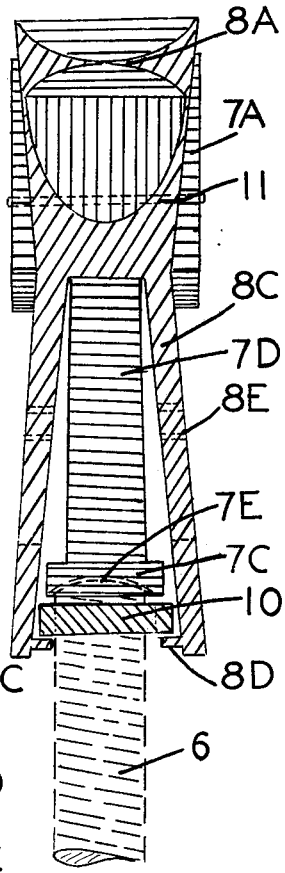
FIG. 3 A frontal sectional view of the pick arm anchor assembly
Figure 4:
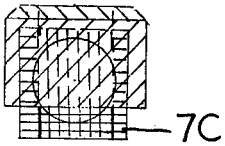
FIG. 4 A top view of the bias thrust wedge
Figure 5:
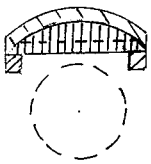
FIG. 5 A top view of the wedge shaped backup wing
Figure 6:
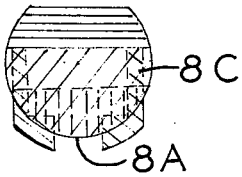
FIG. 6 A top view of the pick arm
Figure 14:
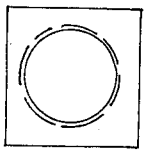
Figure 7:
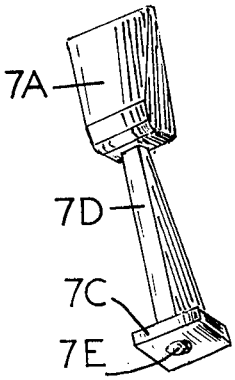
FIG. 7 A perspective view of the bias thrust wedge
Figure 11:
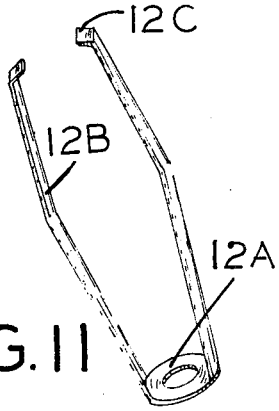
FIG. 11 A perspective view of the stabilizer
Figure 9:
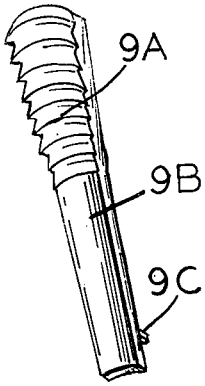
FIG. 9 A perspective view of the backup wing (from the back side)
Figure 8:
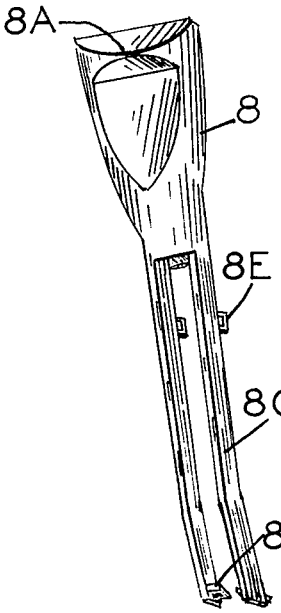
FIG. 8 A perspective view of the pick arm
Figure 10:
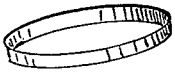
FIG. 10 A perspective view of the elastic band or sleeve
Figure 12:
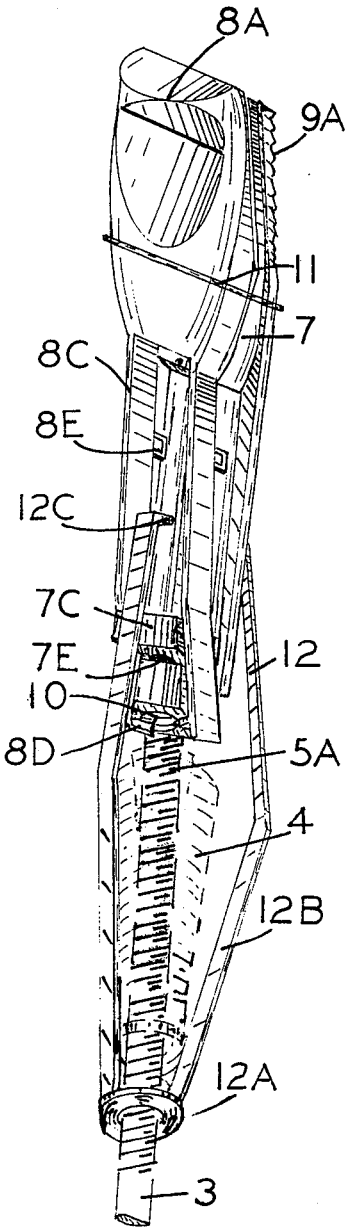
FIG. 12 A perspective view of the pick arm anchor assembly
Figure 13:
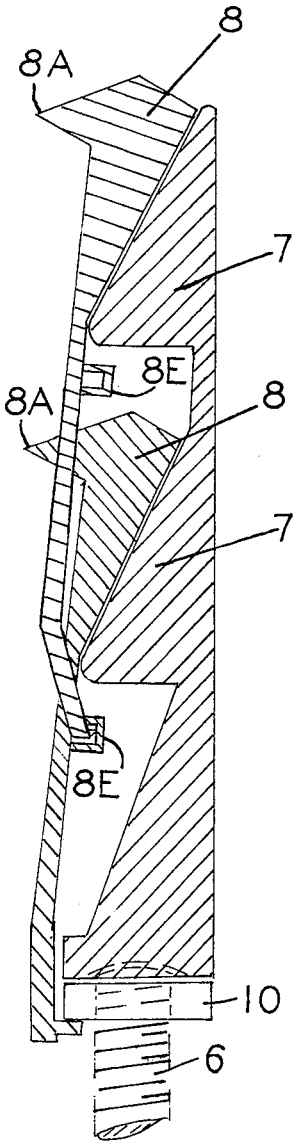
FIG. 13 A partial sectional view of the pick arm and thrust wedge in an alternate configuration of a multiple pick arm anchor assembly FIG. 14 A top view of the threaded base nut FIG. 15 A front sectional view of a conventional expansion shell type roof bolt anchor assembly and the threaded end of a mine roof bolt.
Figure 15:
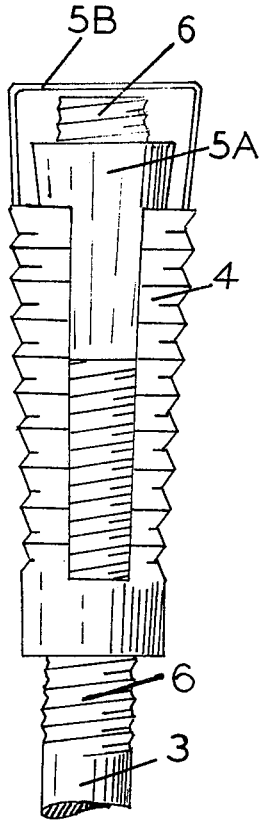
Figure 16:
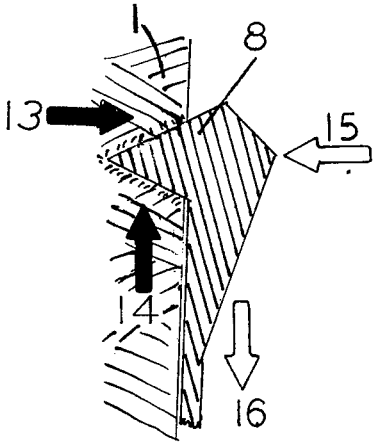
FIG. 16 A diagram of the rock stress resistance to a pick arm installed in place in the wall of a bolt hole.
Figure 17:
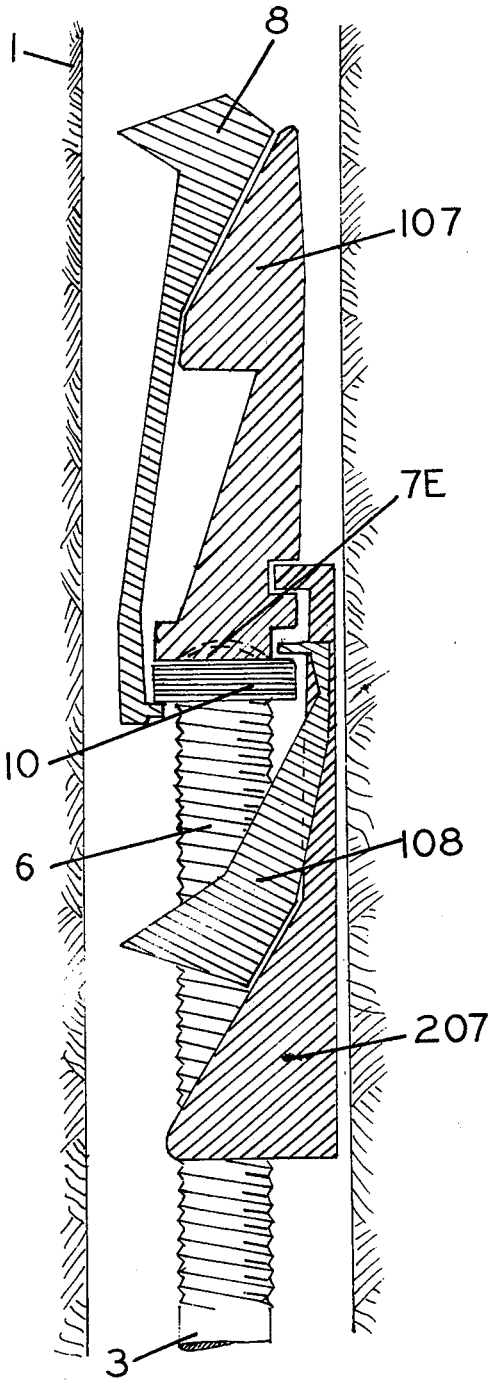
FIG. 17 Alternate configuration of dual pick arm assembly (sectional view)

The pick arm bolt hole anchor assembly consists of a bias thrust wedge (7), a pointed pick arm (8), a wedge shaped backup wing (9), a stabilizer (12), a threaded base nut (10), and an elastic band or sleeve (11). When the pick arm anchor is used in connection with a conventional expansion shell type anchor assembly and assembled to a mine roof bolt, the stabilizer (12) is inserted over the threaded end (6) of a mine roof bolt stem, prior to the attaching of the conventional expansion shell type anchor (FIG. 15) to the mine roof bolt hole stem (6). The bail (**5*b*) of the conventional expansion shell assembly (FIG. 15) should be removed from the expansion shell assembly prior to assembly on the stem (6) of the roof bolt. After the conventional expansion type shell assembly (FIG. 15) is attached to the roof bolt stem (6), the threaded base nut (10) is threaded to the top of the roof bolt stem (6), the pick arm (8) is then attached with the feet (8D) beneath the base of the threaded base nut (10), the bias thrust wedge (7) is then placed on the end of the stem (6) of the roof bolt so that the concave surface (7E) is in contact with the threaded end (6) of the roof bolt stem, the backup wing (9) is then attached with the feet (9C) beneath the base of the threaded base nut (10), the assembly is then held together with an elastic band (11). The complete assembly (pick arm anchor and conventional expansion shell) is then ready to be inserted into the roof bolt hole (2) and tightened in the hole. As the stem of the roof bolt (3**) is turned, it tightens the conventional expansion shell (FIG. 15) within the hole, as it tightens, the wedge nut (5A) advances down the stem (6) of the roof bolt, at the same time the pick arm bolt hole anchor (7) (8) (9) (10) is activated by the outward motion of the pick arm (8) and the backup wing (9) caused by the thrust of the bias thrust wedge (7) which is thrust upward by the end of the roof bolt (6) after the conventional expansion shell (FIG. 15) has engaged or locked into the interior wall (2) of the bolt hole. When the conventional anchor engages the wall of the hole (2) the bolt hole stem (6) advances upward into the hole, activating the pick arm assembly (FIG. 1, FIG. 2). The upward force of the end of the bolt (6) against the concave surface of the thrust wedge (7E) exerts pressure transversely to both the pick arm (8) and the backup wing (9) causing the pick arm point (8A) to be forced into the rock strata exposed in the interior of the bolt hole (2) and the backup wing (9) to be tightly forced against the interior surface of the bolt hole (2), the feet of the pick arm (8D) and the feet of the backup wedge (9C) being held against the base of the threaded base nut (10) prevent the pick arm (8) and backup wing (9) from advancing upward in the hole as the end of the roof bolt stem (6) advances upward in the hole. The stabilizer (12) fits snugly against the interior wall of the bolt hole (2) and prevents the pick arm assembly (FIG. 1, FIG. 2) from rotating in the hole as the roof bolt stem (6) (3) is turned to tighten the assembly in the hole. The bail (5B) of the conventional expansion shell (FIG. 15) is unnecessary when used in connection with the pick arm assembly (FIG. 1, FIG. 2.) and should be removed prior to attachment of the pick arm anchor (FIG. 1, FIG. 2) to the end of the roof bolt stem (6). By variation in the angle of slope (FIG. 1,x) of the coplanar slope surface of the pick arm (8B) and the thrust wedge (7A) both the depth of penetration and the rate of penetration of the point of the pick arm (8A) into the wall of the bolt hole (1) can be controlled. The pick arm anchor may be used with a mine roof bolt (6) without the conventional expansion shell assembly (FIG. 15), and as an alternate employment, a plurality of pick arms in one assembly (FIG. 13), or as another alternate employment a dual pick arm anchor assembly (FIG. 17). FIG. 16 is a diagram showing the transverse (15) and the longitudinal (16) thrust of a pick arm in relation to the transverse (13) and longitudinal (14) stress resistance of rock strata in a bolt hole wall. Preferred material for construction of the invention is steel (except the elastic band) in conformance with ANSI/ASTM Specification F432 "Roof and Rock Bolts and Accessories".

I claim:

1. A pick arm anchor assembly comprising, in combination:

(a) a bolt having a threaded stem for insertion into a bolt hole;

(b) a bolt base plate operably engaged to one end of the threaded stem of said bolt;

(c) a threaded wedge nut having an inner surface adapted for engagement upon the threaded stem of said bolt, and having an outer surface of larger diameter at the upper end thereof and tapering to a smaller diameter at the lower end thereof, said inner surface being adapted for engagement upon the threaded stem of said bolt such that as the bolt is rotated in a first direction, said threaded base nut advances upon said threaded stem;

(d) an expandable outer expansion shell unit having an inner surface for selective engagement with the wedge-shaped outer surfaces of said threaded wedge nut such that as the threaded wedge nut is selectively engaged upon the threaded stem of the bolt as aforesaid, the threaded wedge nut advances down the threaded stem of the bolt, causing the outer surface of the lower end of said threaded wedge nut to selectively engage against the inner surface of the outer expansion shell unit such that as there is more engagement of said wedge nut and outer expansion shell unit, said outer expansion shell unit is expanded radially outward to engage the walls of the bolt hole;

(e) a threaded base nut adapted for selective engagement with the threaded stem of said bolt, such that said base nut is placed on said threaded stem above the larger diameter end of the aforesaid wedge nut;

(f) a pick arm comprising a lower end having a foot for engaging the threaded stem of the bolt between said wedge nut and said base nut and for engaging said base nut to prevent rotation of said base nut as the threaded stem of said bolt is rotated, and further having one or more attachment loops adaptable to receiving additional pick arms, a middle portion having a generally longitudinally concave inner surface, an upper portion having a biased sloped inner surface, and an upper-most portion having a protrusion for engagement with the walls of a bolt hole, as said pick arm is expanded radially outwardly;

(g) a back up wing comprising a lower end having a foot for engagement of the threaded stem of said bolt between said wedge nut and said base nut, a middle portion having a biased sloped inner surface and a generally straight outer surface adapted for positive engagement against the walls of a bolt hole;

(h) a bias thrust wedge adapted for positioning between the inner surface of said back up wing and said longitudinally concave inner surface of said pick arm and having a lower portion adaptable for engagement upon the upper end of the threaded stem of the bolt, a middle portion, and an upper end having outer surfaces with a major bias for engaging the biased sloped inner surface of the upper portion of said pick arm and a minor bias for engaging the bias sloped inner surface of said back up wing, such that as the threaded stem of said bolt is rotated in a first direction as aforesaid, said bias thrust wedge moves in a first longitudinal direction opposite to the aforesaid advancement of said threaded wedge nut causing said major and minor biased outer surfaces of said thrust wedge to engage the inner surfaces of the pick arm and the back up wing respectively as aforesaid, such that said pick arm and back up wing are expanded radially outward to engage the walls of a bolt hole contemporaneously with the advancement of said threaded wedge nut down the threaded stem of said bolt to engage said inner surfaces of said expansion sell unit as aforesaid to cause radial expansion of the outer expansion shell unit;

(i) a stabilizer having a lower end adapted for engagement with the threaded stem of said bolt and positioned below the outer expansion shell unit, one or more legs for engaging the lower portion of the bias thrust wedge and adapted to prevent rotation of the pick arm, back up wing and bias thrust wedge while the threaded stem of the bolt is being rotated; and (j) an elastic expansion band adaptable to contain said pick arm and said back up wing around said bias thrust wedge so as to prevent said pick arm and back up wing from expanding to a greater diameter than that of the bolt hole prior to insertion of the pick arm anchor assembly therein.

2. The invention of claim 1 with addition of one or more pick arm anchor assemblies for use as multiple pick arm anchor assemblies.

3. In a mine roof anchor bolt having a threaded stem, an outer expansion shell unit mounted on said threaded stem and adapted to receive a threaded wedge nut such that as the threaded stem of said bolt is rotated, the threaded wedge nut increasingly engages the outer shell unit causing said outer shell unit to expand radially, the improvement comprising:

(a) a threaded base nut adapted for selective engagement with the threaded stem of said bolt, such that said base nut is placed on said threaded stem above the larger diameter end of the aforesaid wedge nut;

(b) a pick arm comprising a lower end having a foot for engaging the threaded stem of the bolt between said wedge nut and said base nut and for engaging said base nut to prevent rotation of said base nut as the threaded stem of said bolt is rotated, and further having one or more attachment loops adaptable to receive additional pick arms, a middle portion having a generally longitudinally concave inner surface, an upper portion having a biased sloped inner surface, and an upper-most portion having a protrusion for engagement with the walls of a bolt hole, as said pick arm is expanded radially outwardly;

(c) a back up wing comprising a lower end having a foot for engagement of the threaded stem of said bolt between said wedge nut and said base nut, a middle portion having a generally straight inner and outer surface and an upper portion having a biased sloped inner surface and a generally straight outer surface adapted for positive engagement against the walls of a bolt hole;

(d) a bias thrust wedge adapted for positioning between the inner surface of said back up wing and said longitudinal concave inner surface of said pick arm and having a lower portion adaptable for engagement upon the upper end of the threaded stem of the bolt, a middle portion, and an upper end having outer surfaces with a major bias for engaging the biased sloped inner surface of the upper portion of said pick arm and a minor bias for engaging the bias sloped inner surface of said back up wing, such that as the threaded stem of said bolt is rotated in a first direction as aforesaid, said bias thrust wedge moves in a first longitudinal direction opposite to the aforesaid advancement of said threaded wedge nut causing said major and minor biased outer surfaces of said thrust wedge to engage the inner surfaces of the pick arm and the back up wing respectively as aforesaid, such that said pick arm and back up wing are expanded radially outward to engage the walls of a bolt hole contemporaneously with the advancement of said threaded wedge nut down the threaded stem of said bolt to engage said inner surfaces of said expansion shell unit as aforesaid to cause radial expansion of the outer expansion shell unit;

(e) a stabilizer having a lower end adapted for engagement with the threaded stem of said bolt and positioned below the outer expansion shell unit one or more legs for engaging the lower portion of the bias thrust wedge and adapted to prevent rotation of the pick arm, back up wing and bias thrust wedge while the threaded stem of the bolt is being rotated; and (f) an elastic expansion band adaptable to contain said pick arm and said back up wing around said bias thrust wedge so as to prevent said pick arm and back up wing from expanding to a greater diameter than that of the bolt hole prior to insertion of the pick arm anchor assembly therein.

4. The invention of claim 1 or 3 wherein the respective longitudinal heights and slopes of said major biased sloped surface of the upper end of said bias thrust wedge and said biased sloped inner surface of the upper portion of said pick arm and the respective longitudinal heights and slopes of said minor biased sloped surface of said bias thrust wedge and said biased sloped inner surface of said back up wing are selected to provide, when said major biased sloped surface of said bias thrust wedge is engaged with said biased sloped inner surface at said upper portion of said pick arm and when said minor biased surface of said upper end of said bias thrust wedge is engaged with said biased sloped inner surface of said back up wing, movement of said pick arm distance exceeding one half of the diameter of said pick arm anchor assembly to and including a maximum thrust substantially equal to the diameter of said pick arm anchor assembly.

5. The invention of claim 1 or 3 without the inclusion of said stabilizer and said elastic expansion band.

* * * * *